US005996193A

United States Patent [19]

Gill et al.

[11] Patent Number: 5,996,193

[45] Date of Patent: Dec. 7, 1999

[54] BUCKLE FOR USE WITH A PRETENSIONER

[75] Inventors: Harjeet Gill, Windsor, Canada; Carl M. Petersen, III, Waterford; Robin C. Meyer, Clinton Township, Macomb County, both of Mich.; Markell Seitzman, Orchard Lake, Mich.

[73] Assignee: Breed Automotive Technology, Inc., Lakeland, Fla.

[21] Appl. No.: 09/099,756

[22] Filed: Jun. 18, 1998

[51] Int. Cl.[6] ..... A44B 11/26

[52] U.S. Cl. ..... 24/641; 24/633

[58] Field of Search ..... 24/633–642

[56] References Cited

U.S. PATENT DOCUMENTS 5,704,099 1/1998 Cahill ..... 24/633

5,765,266 6/1998 Betz ..... 24/633

*Primary Examiner*—James R. Brittain

*Attorney, Agent, or Firm*—Markell Seitzman

[57] ABSTRACT

A seat belt buckle (100) operable with a pretensioner (330) comprising: a frame (102) having a first latch opening (126*a*) therein, and opposing frame sides (108*a,b*), each side including a latch plate slot (110) arranged generally perpendicular to the direction of movement of a tongue into the buckle and pivoted weight mechanism (112, 200, 220). The buckle additionally includes a latch plate (180), having portions (186) movable within the latch plate slots between a locked position in engagement with an opening within the tongue and with the first latch opening (126*a*), the latch plate moveable between a latched position within the latch opening (126*a*) in the frame and within the latch opening (173) of the tongue to an unlatched position out of the latch openings. The weight (200) as it pivots generates a force upon the latch plate during operation of the pretensioner tending to keep the latch plate in the first opening and a button (250) operatively received upon the frame having ramp means (260) for lifting the latch plate to its unlatched position.

25 Claims, 13 Drawing Sheets

BUCKLE FOR USE WITH A PRETENSIONER

BACKGROUND AND SUMMARY OF THE INVENTION

The present invention generally relates to buckles for seat belts and more particularly to that type of buckle usable with a buckle pretensioner or belt tightener.

The present invention relates to a new and improved buckle for use with a buckle pretensioner of a safety belt system and one which resists the very high g-forces generated when the pretensioner is activated. As known in the art, these g-forces arise as the pretensioner is rapidly moved to remove belt slack about an occupant. At the end of a pretensioning stroke the buckle frame (typically attached to the pretensioner) is suddenly stopped, however, due to inertia, the button will continue to move relative to the now stopped buckle frame. This movement of the button, unless compensated may cause, in certain situations, the latch plate of the buckle to move out of its locked position, permitting the tongue to unlatch.

An object of the present invention is to overcome the above deficiency in the prior art.

Accordingly, the invention comprises: a seat belt buckle operable with a pretensioner connected thereto for moving the buckle a determinable distance to remove slack of the seat belt about an occupant, the buckle comprising: a frame, adapted to be connected to the pretensioner, defining a tongue receiving opening to receive a tongue as the tongue is moved in a first direction, the frame having a first latch opening therein, and opposing frame sides, each side including a latch plate slot arranged generally perpendicular to the first direction. A weight assembly pivotably connected to the frame to generate a line contact force upon the top of the latch plate during operation of the pretensioner forces the latch plate into the latch opening. A manually moveable button is operatively received upon the frame having ramps for lifting the latch plate to its unlatched position. A second embodiment of the invention provides a supplemental button blocking surface on the weight to interact with the button. Another embodiment of the invention is directed to a means for generating a frictional retarding force on the button.

Many other objects and purposes of the invention will be clear from the following detailed description of the drawings.

DETAILED DESCRIPTION OF THE DRAWINGS

Figure 1:
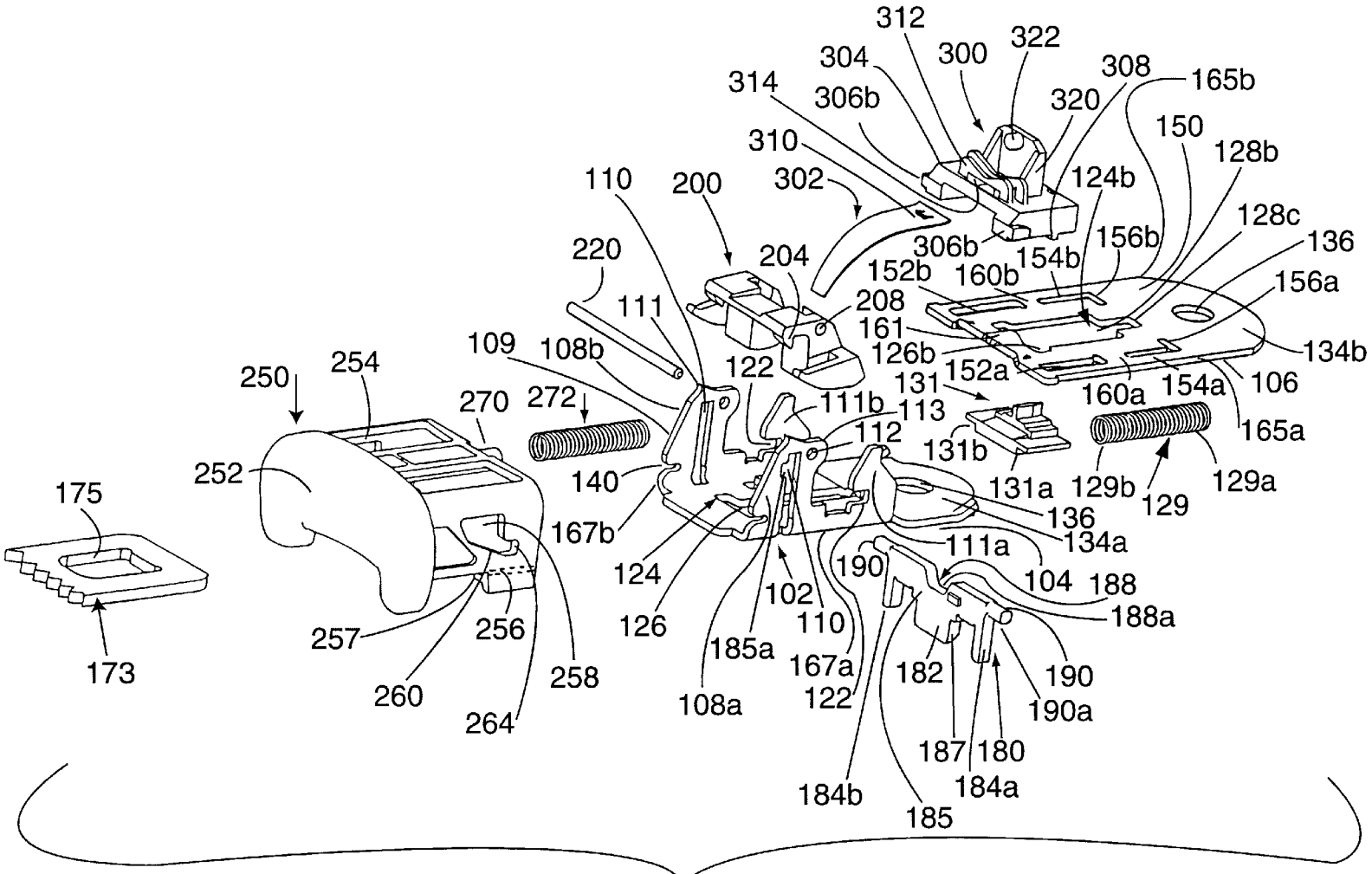
FIG. 1 is an assembly view showing many of the major elements of the present invention.
Figure 2:
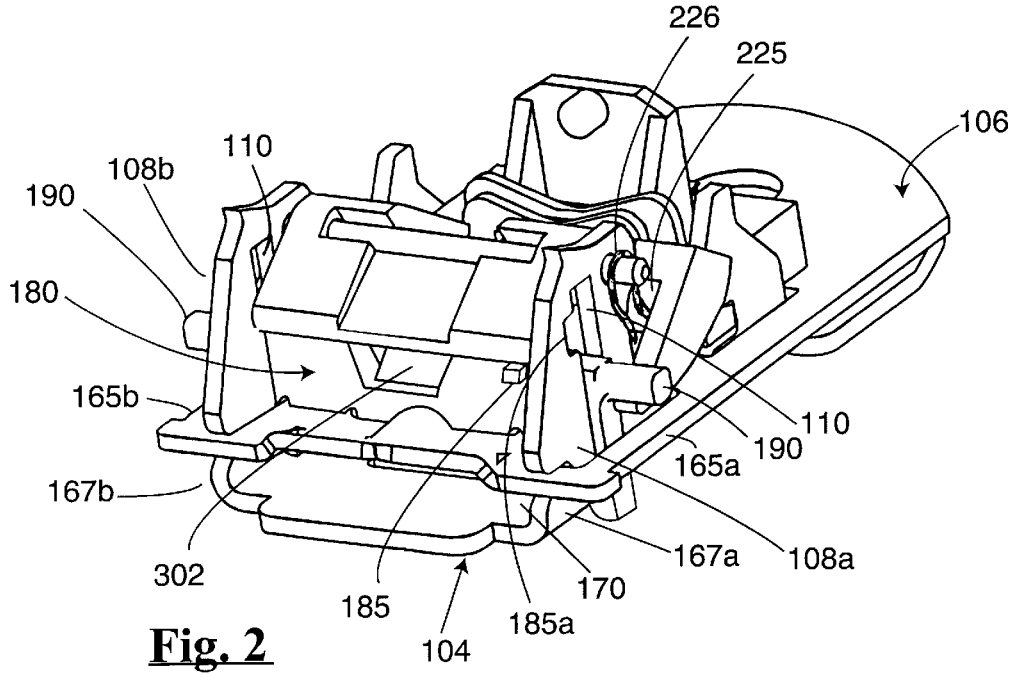
FIG. 2 shows upper and lower frame parts matingly connected with other button parts in their latched condition.

The buckle 100 includes a frame 102 having a lower frame part 104 and an upper frame part 106 which mates with the lower frame part 104. The buckle is covered by a protective hard plastic, hollow cover that is not shown. The lower frame part 104 includes two upraised sides 108*a,b*. Each side 108*a,b* includes a vertical slot 110 which serves as a guide for a vertically movable latch plate 180. Each side further includes a hole (generally round shaped) 112 in an extending lobe portion 113. The forward facing surface 109 of each side 108*a,b* is inclined and terminates in a sharp point which is used to provide an interference fit with the buckle covering. The lower frame part 104 and the upper frame part 106 include a plurality of notches and grooves which permit these two frame parts to be mated together as shown in FIG. 2. With reference again to FIG. 1 and to FIG. 3, the frame part 104 includes a T-shaped slot 124 having a cross-slot (latch opening) 126, which receives a latch portion 182 of the latch plate 180, and an axially extending portion 128. The lower frame part 104 further includes an end piece 134*a* having an optional opening 136. The front of each side 108*a,b* includes a slot 140 which receives and aligns the lower frame part 104 to the upper frame part 106.

Figure 3:
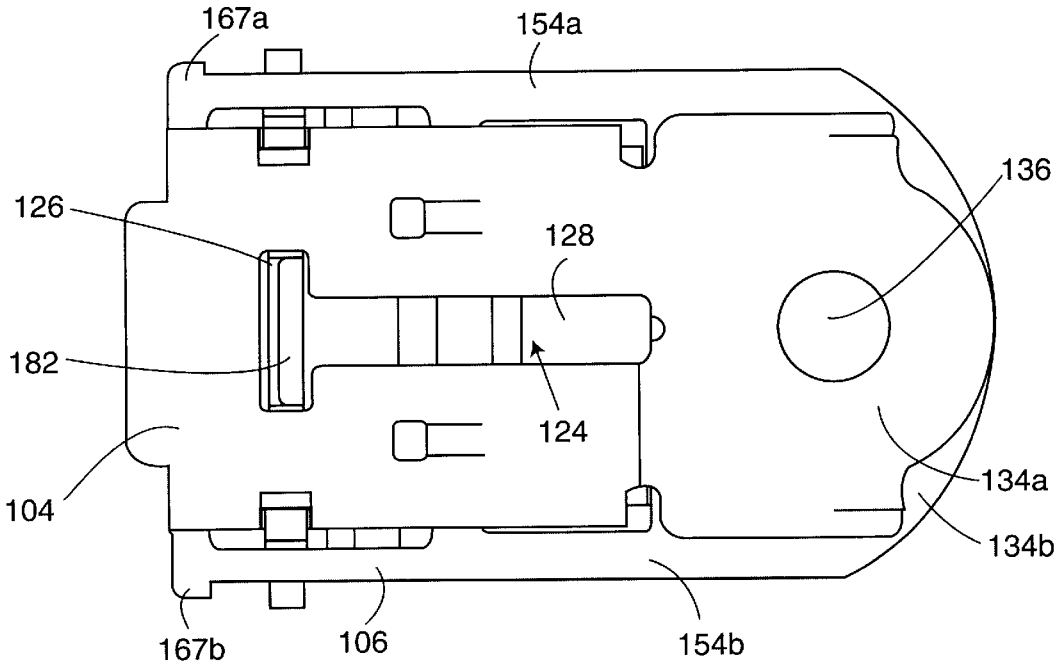
FIG. 3 is a bottom plan view of the buckle.
Figure 4A:
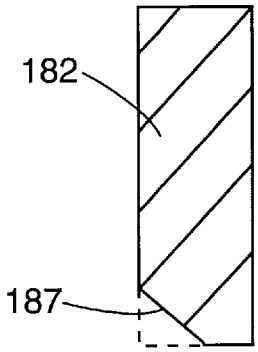
FIGS. 4*a* and 4*b* show a front plan and side plan view of a latch plate.
Figure 4B:
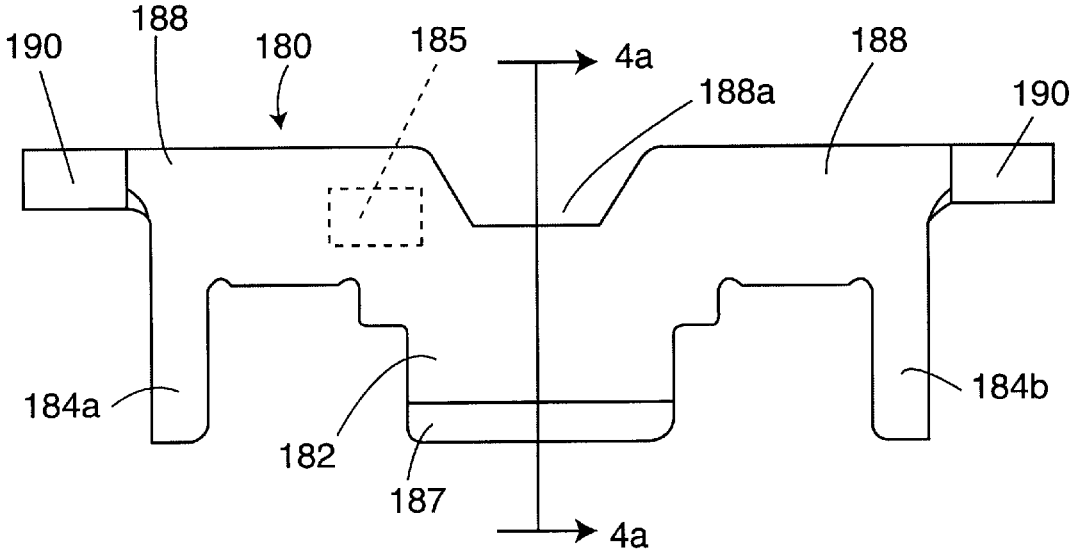
Figure 7:
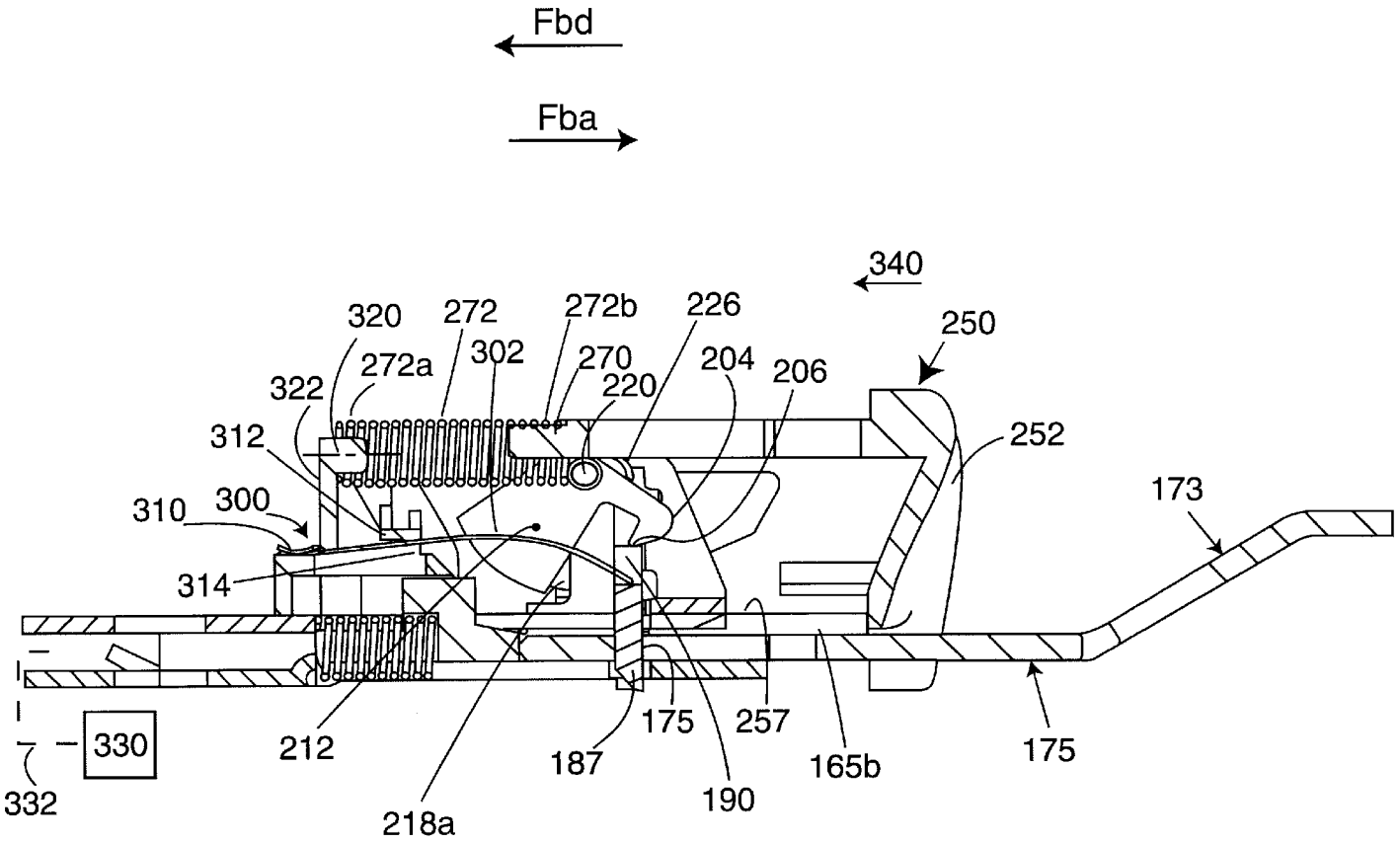
FIG. 7 shows a cross-sectional view of an assembled buckle in its latched configuration with its tongue inserted therein and connected to a pretensioner.

The upper frame part 106 is formed from a thin flat plate 150 having two sets of spaced openings 152*a,b* and 154*a,b,* a central opening 124*b* having a narrow extending slot 128*b* and cross slot 126*b*. Slot 128*b,* when in position upon the lower frame part 104, is generally collinear to and spaced above (see space 170) the axially extending slot portion 128 (in the lower frame part 104). One end 129*a* of an ejector spring 129 is sandwiched between the frame parts 104 and 106 (at the narrow end 128*c* of slot 124*b*) and the other or free end 129*b* biases an ejector 131. The ejector 131 is generally rectangular shaped and is also received in the space 170 between the frame parts. Sides 131*a,b* of the ejector 129 are guided fore and aft against the axially extending portion 128*a* of T-shape slot 124*a* of the lower frame 104. The upper frame part 106 includes an end piece 134*b* having an optional opening 136 of the same size as opening 136 in the lower frame part 104. When the frame parts 104 and 106 are attached, these openings 136 are aligned one to the other. This configuration is shown in FIGS. 2 and 3. A cable or metal strap, shown diagrammatically as 332, can be attached (such as being riveted) to the buckle 100 through the end pieces 134*a,b,* in a known manner, typically through the aligned openings 136 and attached to a belt tensioning device which is also referred to as a pretensioner 330 as shown in FIG. 7.

The assembly of the lower and upper frame parts is rather conventional and known in the art. The slots 152*a,b* of the upper frame part 106 are received within the slots 140 on the front of the sides 108*a,b* and the upper frame part is then rotated downward so that the sides 108*a,b* extend therethrough. The upper frame part 106 is laid upon the lower frame part 104 with medial portions 160*a* and 160*b* resting upon the top of the opposing slot or groove 116 in each side. The upraised ends 111*a,b* of each respective side 108*a,b* extend through a corresponding opening 154*a,b* respectively. The front 161 of the upper frame part 106 is bent upwardly (see FIGS. 1 and 2) so that when in place on the lower frame part 104 it cooperates to define a slot 170 (see FIG. 2) through which a tongue 173 is received. The sides 165*a,b* of the upper frame plate 106 extend outward over the corresponding sides 167*a,b* of the lower frame part 104. A button 250 is movable on sides 165*a,b*.

As mentioned the latch plate 180 is movably situated upon the sides 108*a,b*. The latch plate 180, as shown in FIGS. 1, 2, 4*a* and 4*b*, includes the central latch portion 182 which when in a locked or latched position is received within the slots (latch openings) 126*a*, 126*b* and within a latch receiving opening 175 of the tongue 173. The latch plate also includes two side legs 184*a,b*, which are slidably received and guided in the frame slots 110, and two extending, typically square-shaped ends or wings 190. The lower tip 187 (also see FIG. 4*a*) of the central latch portion, which extends through slots 126*a* and 126*b*, may be chamfered or flat as shown in phantom line (see FIG. 4*a*). The latch plate 180 further includes a top 188 having a lowered center portion 188*a*. A leaf spring 302 acts upon the top center portion 188*a* to bias the latch plate 180 downwardly into the slots 126*a*, 126*b* in the frame parts to its latched position (as shown in FIG. 2. During assembly the latch plate 180 is first slid into the right side slot 110 and then into the left side slot 110. To insure that the latch plate 180 is facing as illustrated in FIGS. 1 and 2, the latch plate 180 and the lower frame 104 include error proofing features to preclude the latch plate being installed in a reverse or opposite manner. These error proofing features include a projection 185 of the right hand, front facing surface (see FIG. 1) on the latch plate 180 and a complementary groove or key way 185*a* formed in the right hand slot 110. As can be appreciated, if the latch plate 180 is rotated 180° about a vertical axis it would not be possible to install it within the slot 110 as the projection 185 would be blocked upon contacting side wall 108*a*.

Figure 5:
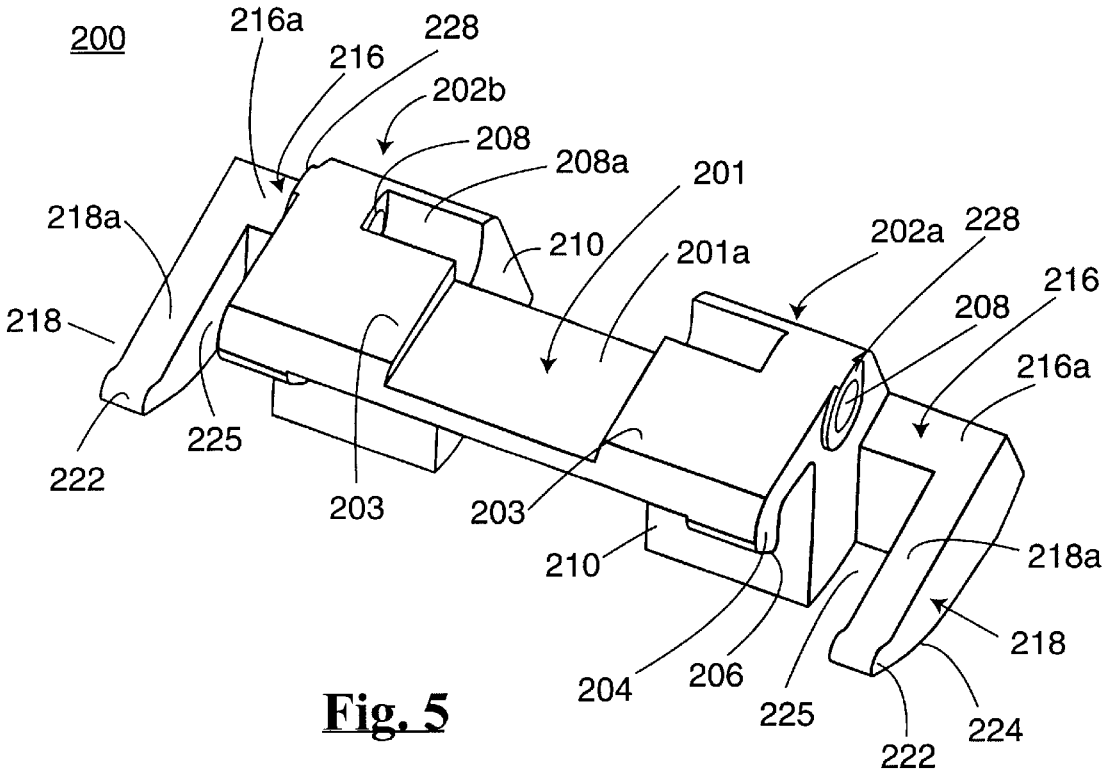
FIG. 5 is an isolated isometric view of a weight.
Figure 6A:
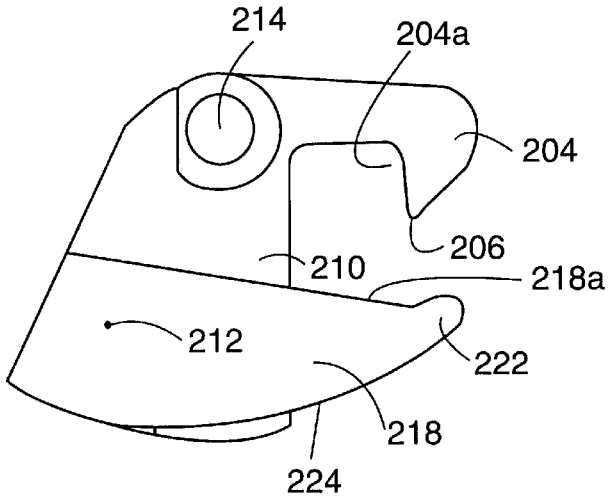
FIGS. 6*a* and 6*b* are respective side plan and front plan views of a weight.
Figure 6B:
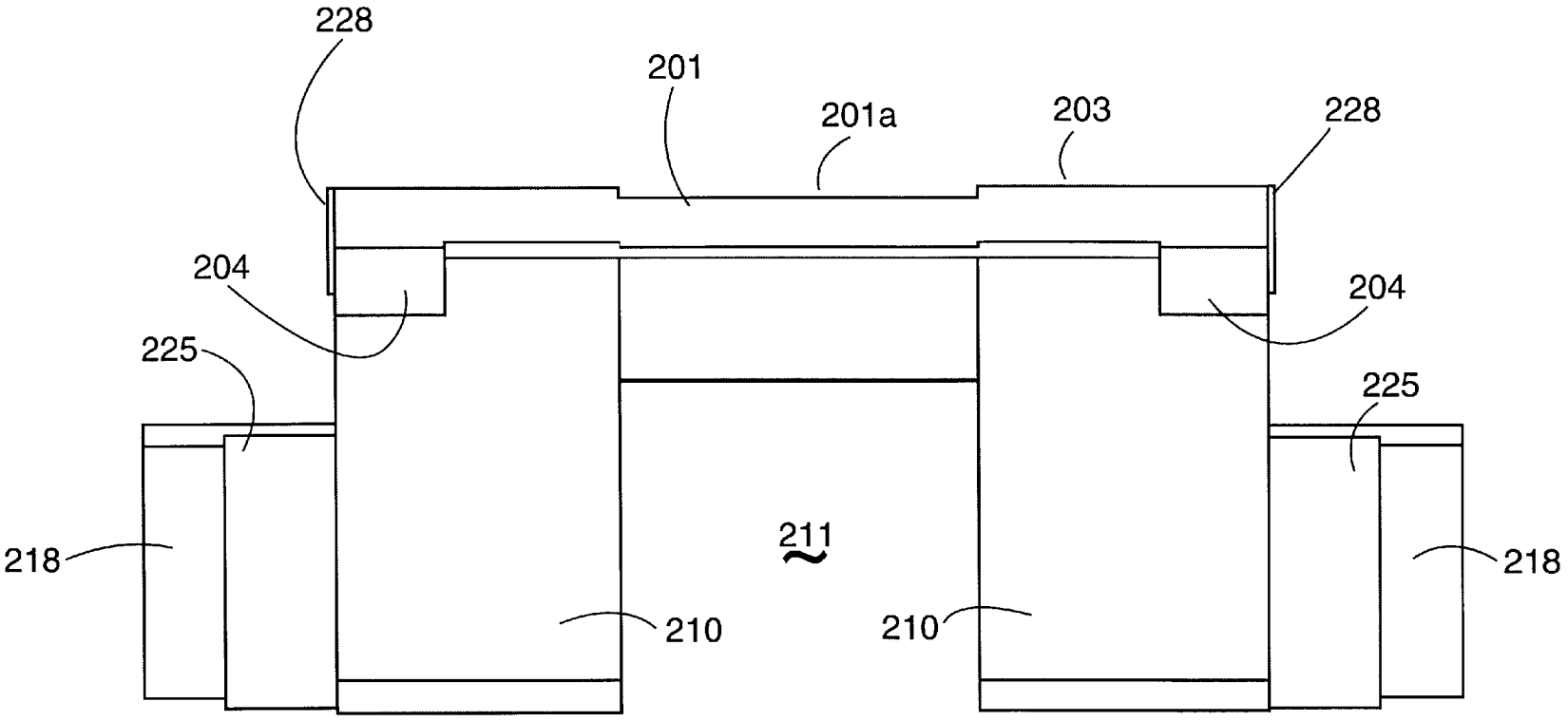

The latch plate 180 operates in conjunction with a weight or inertia mass 200. The weight 200 as shown in FIGS. 5, 6*a* and 6*b* includes a center section 201 and left and right (first and second) segments 202*a,b* which are generally the mirror image of each other. Each segment 202*a* and 202*b* includes a forward extending hook portion 204 (see FIGS. 6*a* and 6*b*) defining a line contact or engagement surface 206, and a bore 208 through which is received the pin 220 (as shown in FIG. 2). Each hook 204 also defines a hooked recess 204*a*. Part of the bore 208 at 208*a* is exposed and is slightly over sized to permit easy passage of the pin 220 therethrough. The pin 220 and opposing bores 208 define an axis of rotation 214 (see FIG. 6*a*) of the mass 200. Each segment 202*a,b* of the mass 200 includes a depending lobe 210 which extends below a corresponding bore 208, i.e. the axis of rotation 214, to assist in placing the center of gravity (cg) 212 of the mass 200 below the center of the axis of rotation 214. Each lobe 210 is spaced apart, this spacing shown by numeral 211. Each segment 202*a,b* further includes a laterally extending portion 216 and a forward extending portion 218. The tops 216*a* and 218*a* of the respective portions 216 and 218 (of each segment 202*a,b*) are generally co-planar but recessed below the respective top 203 of each sector 202*a* and 202*b*. Each forward extending portion 218 includes an upraised tip 222 which extends slightly above the top (top surface) 218*a*. The bottom 224 of each portion 218 is arcuately shaped, the purpose of which is to provide clearance with portions of the push button 250 during rotation of the weight 200. Each portion 218 is spaced from a corresponding depending lobe 210 to form a slot or groove 225. An optional anti-rattle spring such as torsion spring 226 may be used to bias the weight away from the frame and against the latch plate 180. As shown in FIG. 2, one leg of a spring 226 is adjacent an edge of side 108*a* while the other leg of the spring is received within the groove 225 on the right hand side of the weight to generate a counter clockwise bias force on the weight. A second bias spring may be similarly placed on the other side 108*b* of the frame and operate on the left hand groove 225 of the weight. The anti-rattle spring may be implemented in a number of ways such as by fabricating one or more plastic, integral spring fingers 226*a*, as shown in FIG. 7, which extend down from an under surface of the top of the button and bias the weight toward the latch plate 180. Reference is again made to the center section 201. The top 201*a* of this section 201 is recessed below the adjacent tops 203 of each lobe 202*a* and 202*b* to provide clearance to portions of the button 250. Each lobe 210 includes an outward facing circular projection or stand-off 228 which serves to minimize sliding friction between lobe 210 and a corresponding portion of the inner wall 132*a,b* of the frame sides 108*a* and 108*b* respectively.

Figure 8:
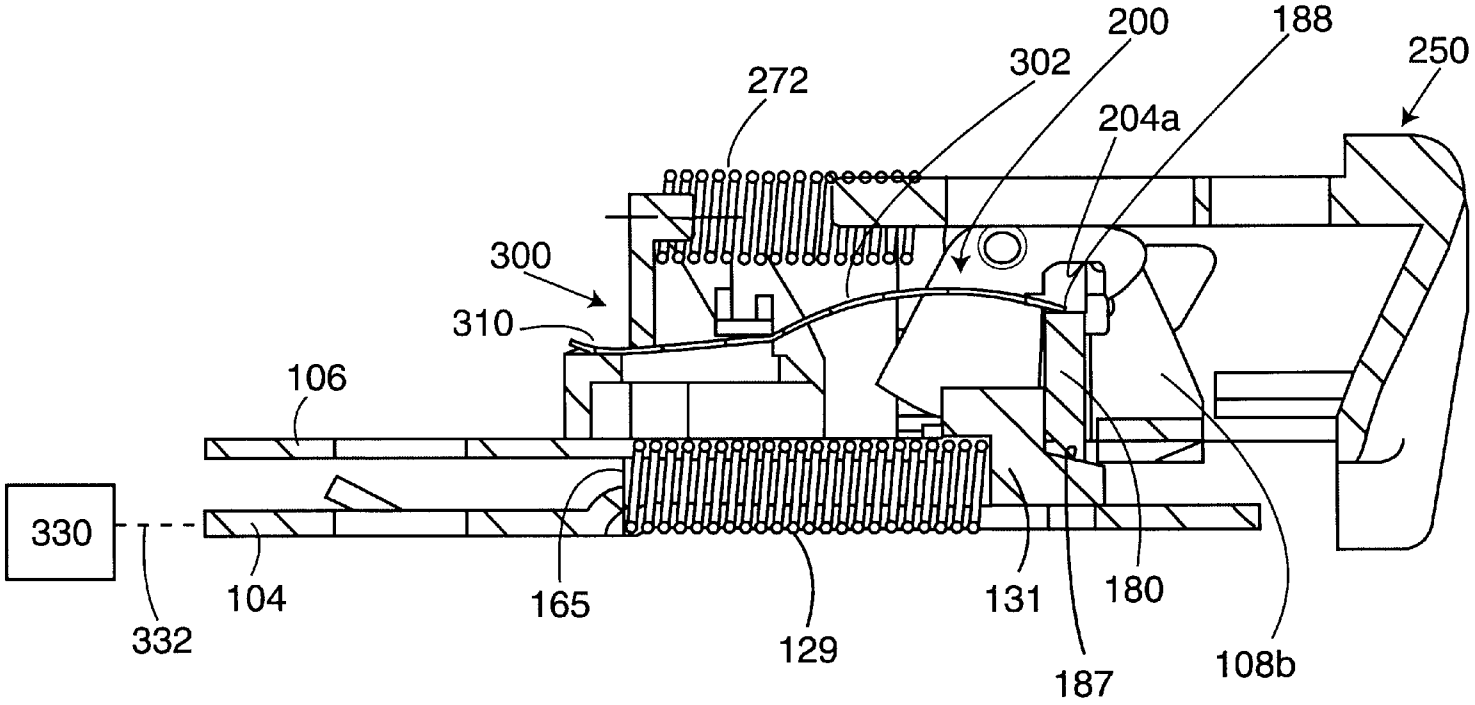
FIG. 8 is a cross-sectional view showing the buckle in its unlatched configuration.

The leaf spring 302 is supported by and is part of a spring assembly 300. This type of spring assembly is well known in the art. The spring assembly 300 is also shown in FIGS. 7 and 8. The spring assembly 300 includes a body 304 having two small laterally extending, generally cube-like projections 306*a,b*, which are received into a corresponding slot 122 (see FIG. 1) of frame parts 111*a* and 111*b* respectively. The body 304 also includes two spaced depending projections 308 (only one of which can be seen in FIG. 1) which extend below the main portion of body 304 and which are received within a corresponding slot 156*a,b* of the top frame part 106. The body 304 of the spring assembly 300 further includes means for retaining an end 310 of the spring 302. This can be achieved in a number of ways. In the illustrated embodiment of the invention the body 304 includes a portion 312 which is elevated above the body 304 to define a space 314. The spring 302 is received within this space 314 and its end 310 secured to the rear of the elevated portion 312. The body also includes a riser 320 having a boss 322 which receives the end 272*a* of push button spring 272.

During the assembly of the upper and lower frame parts 104 and 106 the latch plate 180 is inserted between the guide slots 110 of the lower frame 104 so that its ends or wings 190 extend laterally from each side 110*a,b* respectively. The spring assembly 300 is secured to the upper frame part 106 so that the spring 302 fits upon the top 188*a* of the latch 180. Also during assembly the ejector and ejector spring are placed between the frame parts 104 and 106. Thereafter the weight 200 is mounted to the frame 102. With the latch plate 180 in an elevated position within the guide slots 110, the hooks 204 are positioned in front of a corresponding front portion 188*c* and 188*d* of the latch 180 with the forward extending portions 218 positioned below a respective end 190. The weight 200 is manipulated so that its bore(s) 208 are co-linear with the opening 112 in each frame side 108*a,b*. Thereafter the pin 220 is inserted with the openings 112 and bores 208 to secure the weight to the frame 102. The sides 108*a,b* are positioned within a respective one of the slots 224 on either side of the weight 200. If an anti-rattle spring 226 is used, it is then secured to the frame and weight. In essence, this configuration shows the relative orientation of the above buckle parts in the unlatched or unlocked mode of operation of the buckle which is shown in FIG. 8.

As mentioned above, the buckle 100 also includes a button 250. The button 250 is slidably received upon the frame 102. The button 250 includes an end 252 which is depressed (by its user) to release the tongue 173 from the buckle 100, a top 254 and extending sides 256. Each side 256 of the button 250 includes an opposingly situated slot (or recess) 257 of generally known construction, and slides upon a corresponding extending side 165*a* or 165*b* of the upper frame part 106. Each button side 256 includes an opening, slot or recess 258 therein, one portion of which is formed as a ramp 260 which engages a lower surface 190*a* of a corresponding end 190 and lifts same. A second portion of the slot (or recess) 258 is formed as a notch or horizontal guide 264 and is positioned over the ends 190 of the latch plate 180 to prevent the latch plate from lifting or being lifted out of the latch opening or slots 126*a* and 126*b* in the lower and upper frame arts and tongue slot 175.

The top 254 of the button further includes a pin formation 270 which extends into a button bias spring 272. As can be seen from FIGS. 1, 7, 8 and 9, the end 272*b* of spring 272 is received upon and supported by the pin 270. The left-hand end 272*a* of spring 272 is received upon the boss 322 of riser 320. The riser 320 provides a reaction surface for the bias spring 272.

Returning briefly to FIG. 8, this figure is a cross-sectional view illustrating the buckle 100 in its unlatched position. In this figure, the latch plate 180 was previously lifted upwardly by the ramps 260 of the button 250 to place the latch in the position illustrated. More specifically, as the button was pushed in, the opposing ramps 260 engaged the bottom 190*a* of each end or wing 190 and lifted same to its unlatched or elevated position. As the latch plate 180 is urged upwardly, this motion pushes each wing 204 upwardly causing the weight to pivot about the pin 220 (in a counter clockwise manner as seen in FIG. 8). This rotation moves the wings 204 off of the top 188 of the latch plate 180 and permits the latch plate to become positioned within the groove or pocket 204*a* of each wing 204. Additionally, with the latch plate 180 in its elevated position, the ejector bias spring 129 has moved the ejector 131 forward such that it rests below and supports the tip end 187 of the latch plate 180.

Figure 9:
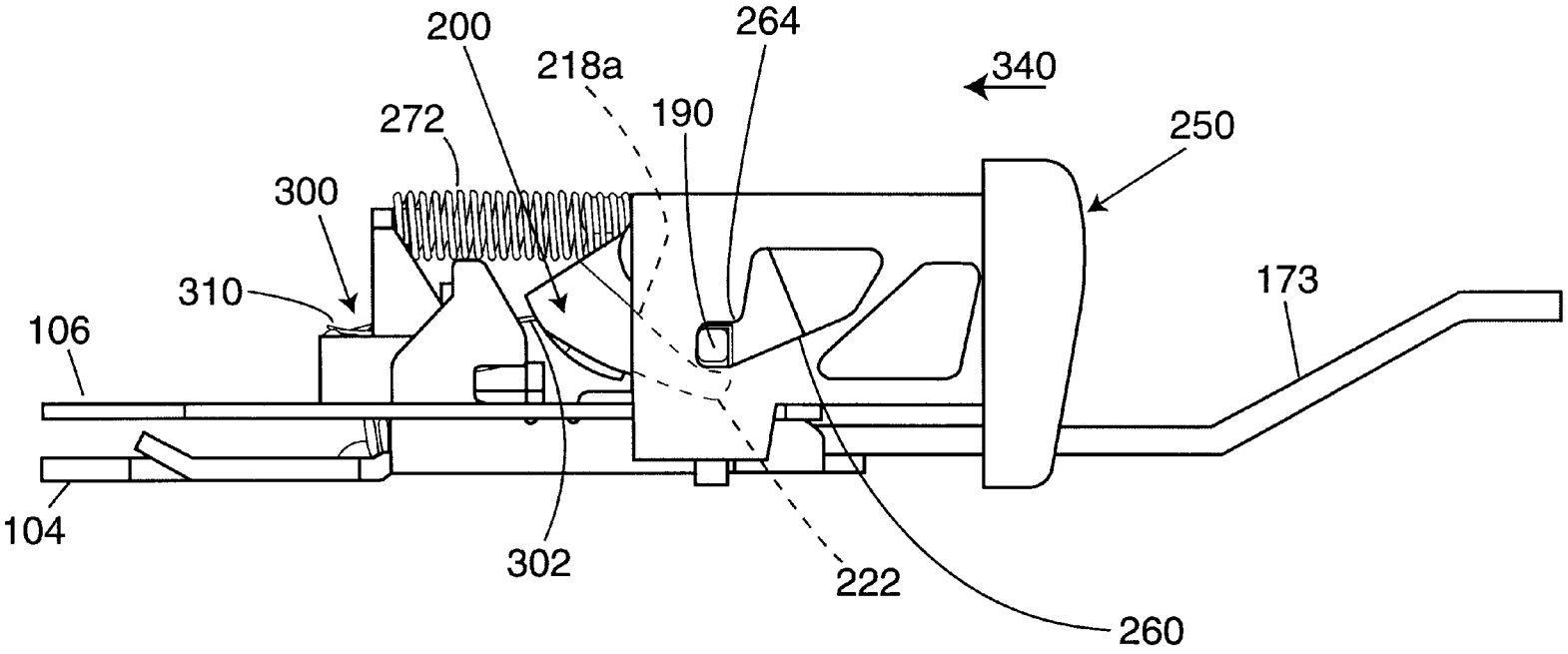
FIG. 9 is a side plan view of the buckle in a latched condition, showing a button in relation to other components of the buckle.

FIG. 9 shows the buckle in its latched condition. To release the tongue 173 the button 250 is depressed (see direction of arrow 340). As the button is pushed to the right, the horizontal notch guide 264 over-travels the ends 190 of the latch plate 180 and the ramps 260 (on each side of the button 250) and after moving a short distance lifts the weight 200 and latch plate 180 upwards out of the slots 126*a,b* in the frame parts and the slot 175 in the tongue 173. Thereafter, the ejector 131 ejects the tongue from the buckle 100.

Reference is again briefly made to FIGS. 7 and 9 which show many of the buckle parts in their respective positions with the tongue 173 latched in place. When the tongue 173 is inserted within the buckle it engages the ejector 131 and moves it rearward permitting the spring 302 to urge the latch plate 180 downwardly into the openings 126*a* and 126*b* in the frame 102 and in the opening 175 in the tongue 173. As the latch plate 180 moves downward in the frame the ends or wings 190 of the latch plate 180 engage the top of a respective wing 218 of the weight 200 causing the weight 200 to rotate about pin 220. With the latch plate 180 in its latched position the engagement wings 204 of the weight 200 will be positioned upon the top 188 of the latch plate with the engagement surface 206 thereon.

The following describes the operation of the buckle 100 during pretensioner operation. Upon sensing a crash, the vehicle's electronic control unit (not shown) generates a signal to activate the pretensioner 330. A typical, pyrotechnic pretensioner of known construction includes a tube with a moveable piston therein. The piston is connected to the buckle ends 134*a,b* via a cable 332 (see FIG. 7) initially accelerating the buckle in the direction of arrow 340. As the buckle is accelerated the frame parts move to the left (in FIG. 7) and the button 250 moves relatively to the right and is stopped by interaction with the ends or wings 190 of latch plate 180. During this very short time period the weight 200 tends to pivot in a counter-clockwise manner about the rod or pin 220 (the center of gravity of the weights is shown by numeral 212). The tendency of the weight 200 to move is stopped by the interaction of surface 218*a* of arm 218 of weight 200 on the bottom surface 190*a* of wing 190 of latch plate 180. The tendency of the latch plate 180 to be lifted by the rotation of the weight is stopped by the guide 264. The inertial force acting on the button, during this accelerative phase, is shown as $F_{BA}$.

Within 3–15 milliseconds of the activation of the pretensioner 330 the downward motion (motion to the left as seen in FIG. 7) of the buckle frame is rapidly decelerated as the buckle frame stops at the end of the travel of the pretensioner 330, typically about 80 mm. The button 250, which will move with the frame 102, will tend to stay in motion even after the buckle frame parts are rapidly stopped. The inertial force acting on the button, during this decelerative phase, is shown as $F_{BD}$. During this decelerative phase of operation of the buckle 100, the weight 200 (due to the placement of its center of gravity 212) will tend to rotate clockwise. In the latched position of FIG. 7 the engagement surface 206 of each engagement hook 204 rests upon the top of the latch plate 180. The curvature of the hooks 204 in relationship to the flat profile of the top of the latch plate 180 provides for a line contact between each hook 204 and a respective mating portion of the latch plate 180. In this configuration the latch plate 180, and more particularly the center portion 182, is positioned within the various latch openings 126*a,b* and 173 in the frame and in the tongue. This configuration prevents the weight 200 from rotating in a clockwise direction. However, as mentioned above, in response to the decelerative forces' input to the weight 200, the weight will attempt to rotate in a clockwise direction thereby urging the hooks with greater force onto the latch plate 180. During this decelerative phase the button 250 will also tend to travel to the left (see FIG. 7) and try to lift the latch plate out of the various slots. This motion is resisted by the inertial forces imparted to the latch plate 180 by the weight. To insure that the button 250 does not lift the latch plate 180 out of the various slots the resultant force (or torque) generated by the weights must be greater than the force imparted by the button 250 to the latch plate.

Figure 10:
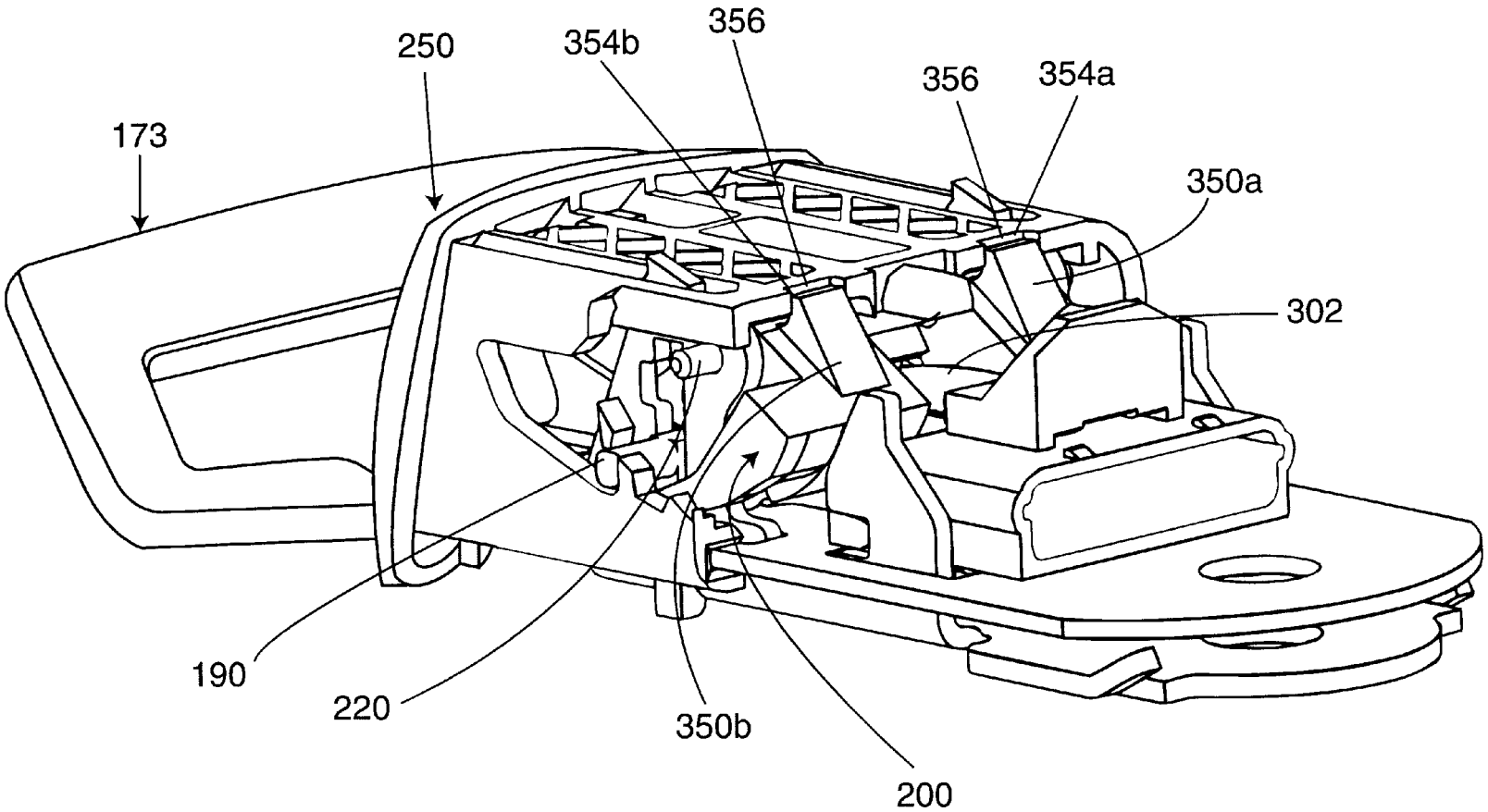
FIG. 10 shows an isometric view of an alternate embodiment of the invention showing a buckle including its frame and button, with part of the button removed.
Figure 11:
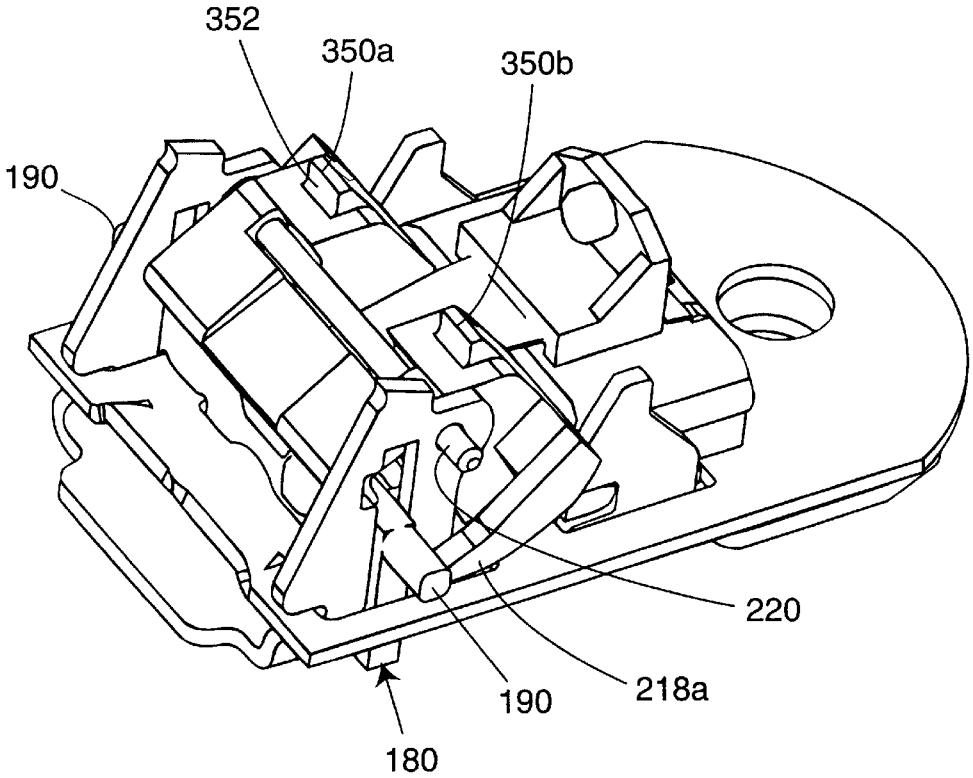
FIG. 11 is another view of the embodiment of FIG. 10 with the button removed.
Figure 12:
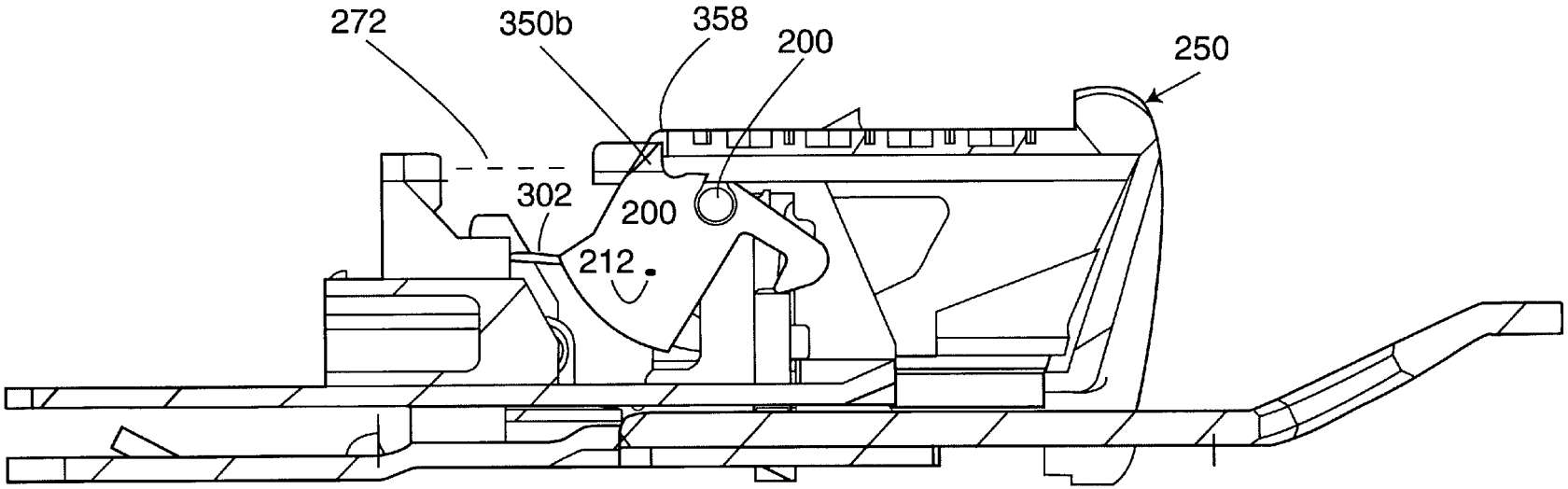
FIG. 12 is a side cross-sectional view generally taken to the show relationship of the ears or projections of this embodiment to the button.

Reference is briefly made to FIGS. 10 through 12 which illustrate an alternate embodiment of the invention. FIG. 11 shows the orientation of the buckle parts in a locked condition as though the tongue 173 were inserted; the tongue is not shown. As can be seen the latch plate 180 is positioned through the openings in the upper and lower frame parts. The major differences of this embodiment in comparison to the buckle shown in FIG. 1 is the inclusion on the top of the weight 200 of two upstanding ears or projections 350*a* and 350*b* and the inclusion on the top rear surface of the button 250 of two notches 354*a* and 354*b*. The front face 352 of each of the ears 350*a,b* is flat. With the buckle 100 in its latched condition, the front face 352 of each projection 350*a,b* is oriented generally vertical and spaced (the space is shown by numeral 358 and is about 1 millimeter wide)

from the base 356 of each notch 354*a,b*. As will be recalled the button 250 is biased by spring 272 towards the top of the buckle, that is away from the projections 350*a,b*. As will be seen, the base 256 of each notch 354*a,b* serves as a reaction surface, as such, it is not necessary to use an actual notch so long as a reaction surface is provided. As can be appreciated the end face across the rear of the button 250, at a location of the bases 356, can be made flat thereby eliminating the notched contour.

The operation of this embodiment is basically identical to that of the buckle shown in FIG. 1. If however, the inertial force or torque generated by the weight 200 on the latch plate 180 is not sufficient to counter the lifting force created by button on the underside of the wings 190 of the latch plate, the latch plate 180 will begin to rise as it reacts with the ramps 260 and the button will also move to the right in FIG. 12. This slight added movement of the button 250 will place the base 356 in direct contact with the front face 352 of each of the projections 350*a,b* of the weight 200 (because of the interdependence of the weight 200 due to the location of the engagement surface 206 with the top of the latch plate 180 the weight 200 will have been rotated slightly due to the upward motion of the latch plate). As can be seen from FIG. 12 the moment arm from the pin 220 to each ear 350*a,b* is less than the corresponding moment arm from the pin 220 to the cg 212. Consequently, the inertial forces that are generated by the button at the ears 350*a,b* will be less than those generated by the cg 212 about the pin 220 which are sufficient to prevent or block any further movement of the button during pretensioner firing. During the normal operation of the buckle, that is, during unlatching of the tongue 173 from the buckle, the ears or projections 350*a,b* are pushed backward by the advancing base or reaction surface 356 of the button 250 to rotate the weight 200. Additionally, as the button is moved inwardly the ramps 260 lift the latch plate 180 which in turn lifts the weight 200 at the wings 204 and rotates the weight.

Figure 14:
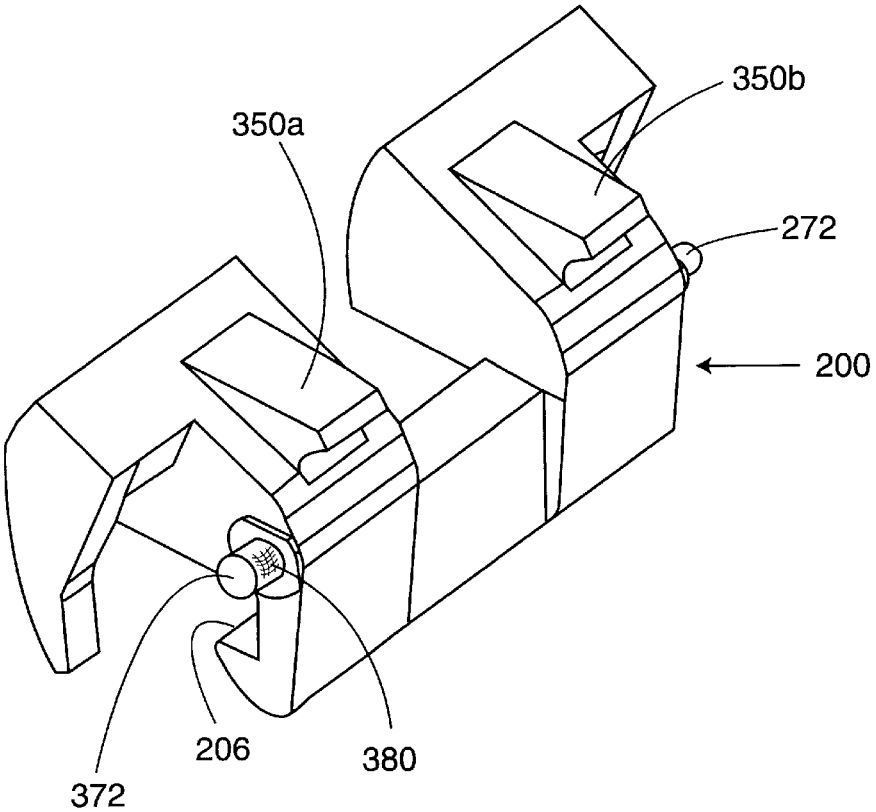
FIGS. 13 through 15 show a further embodiment of the invention.
Figure 13:
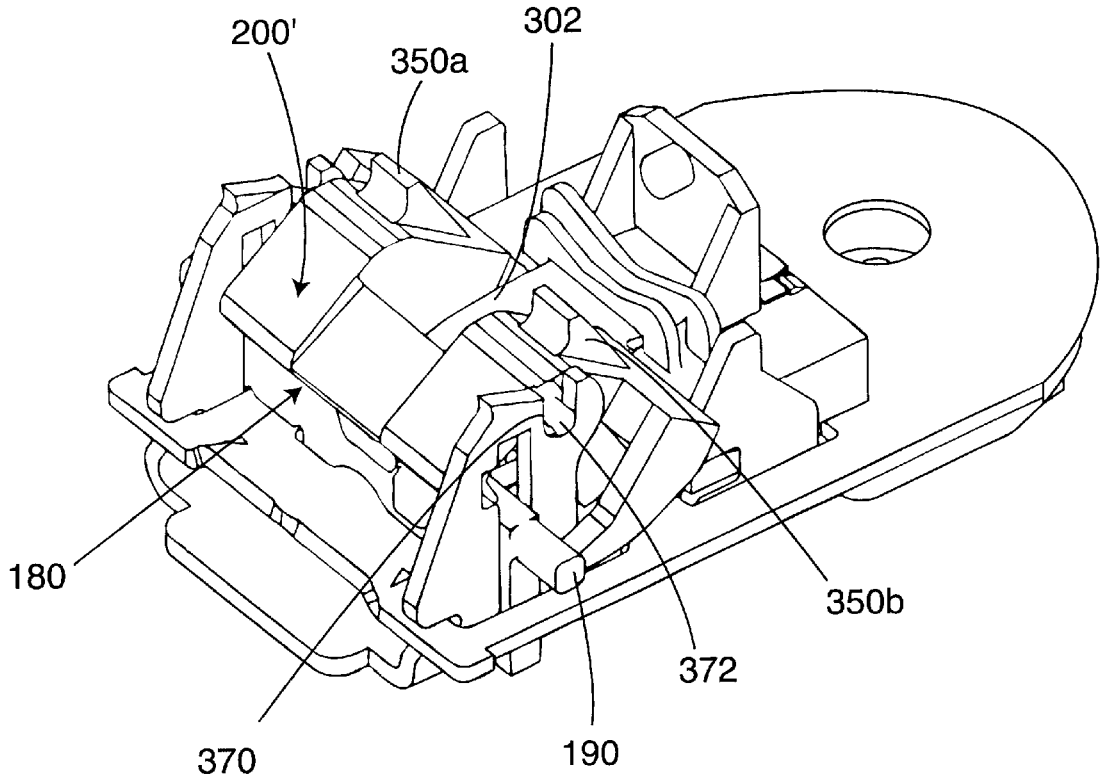
Figure 15:
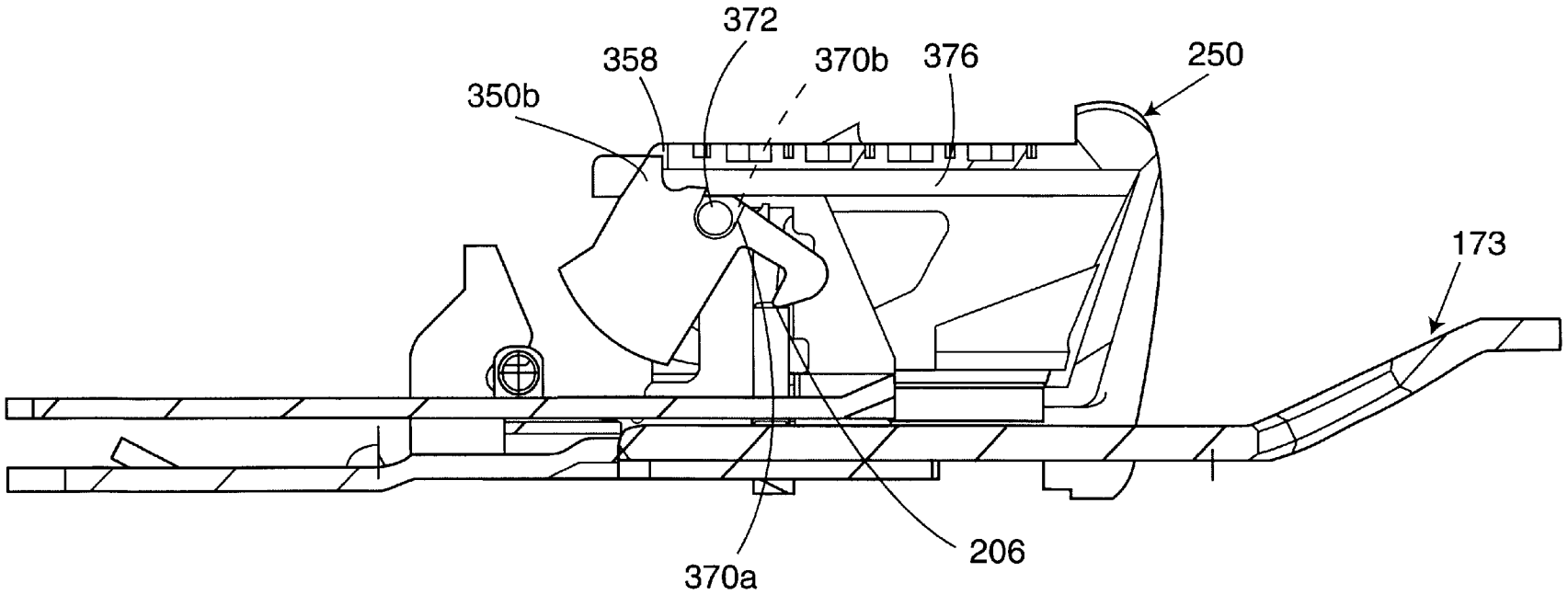

Reference is briefly made to FIGS. 13 through 15 which show a further embodiment of the invention. First though, reference is again made to FIG. 1. As mentioned, during assembly the weight 200 is lowered onto the frame 102 and the pin 220 is inserted from one side of the lower frame part 104 through the opening 112, then through the bore 208 of the weight and through the other second opening 212 on the other side of the lower frame part 104. This process is not particularly amenable to automated assembly. The embodiment of FIGS. 13 through 15 provides for a greater ease of assembly. The openings 112 have been replaced with open topped slots or notches 370 which will permit the weight to be inserted generally vertically onto the frame. These opposing notches 370 can have vertical, angled or arcuate (radial) walls. The walls can be parallel or diverging such as v-shaped to permit the weight to pivot as described below. The width of the slot can be oversized or just slightly wider than the width of the axles 372 so as not to impede the requisite movement of the weight. The notch 370 shown in FIG. 13 is vertically oriented but sufficiently wide to permit the weight to move. The notch 370*a* of FIG. 15 is angled in the direction of the button 250. The superposed notch 370*b*, shown in phantom line, illustrates a notch with arcuate or radial walls with its center of curvature at the intersection of the engagement surface 206 and the latch plate 180. This change in the construction of the frame permits a change to the weight, now shown as 200'. As can be seen, from FIG. 14, the bores 208 and 208*a* have been removed and the weight 200' additionally includes opposing integral stub axles or pivots 372. During assembly the weight is simply positioned into the slots 370 with the stub axles 372 rotatable therein. To insure that the stub axles 372 remain in place, the top undersurface 376 of the button 250 is fabricated with longitudinally extending ribs or projections 380 which are slightly spaced from the top of each stub axle 372 preventing the stub axle from being lifted out of the slot. Part of the top of the weight 200' has been removed to more clearly shown the undersurface 376. Further, a modification of the above construction using two opened topped slots can be achieved by retaining one of the pin openings 112 in one of the frame sides, for example 108*a*. The opposing frame side 108*b* would include the open topped slot or notch such as 370. In this variation of the invention, during assembly, one of the stub axles is first inserted within the opening 112 and the other stub axle is simply dropped into the slot such as 370.

The operation of this embodiment is substantially the same as described above. As can be appreciated, the slotted frame and modified weight can be used in any of the other embodiments of the invention. More particularly, the operation of the embodiment shown in FIGS. 13–15 at the end of the pretensioner stroke is as follows: The weight 200' will rotate in a clockwise manner about the stub axles 372 which would be located on the bottom of each slot 370 (or slot 370 and opening 112 in the alternate construction mentioned above), as did weight 200 about pin 220, and generate an inertial force which acts on the latch plate 180 via the engagement surfaces 206. Since one or both of the axles 372 are not restrained in view of the open topped slot(s) 370, or 370*a*, the weight 200' will pivot about the engagement surface(s) 206 (including the integral axles 372) generally upwardly. The axles will move within the slots 370, 370*a*. As mentioned, these slots or notches can be vertically oriented, v-shaped, sloped (off-vertical) or arcuately (radial) curved to follow the rotational arc of the pivoting axles. If the notches 370, 370*a* are not radial, they need to be sufficiently wide to permit the weight and axles to move. As previously mentioned, the button includes ribs or undersurface 376 which prevent the axles from being lifted out of the slots 370. The movement of the weight 200' and stub axles 372, in view of the inertial forces acting thereon, generate a large normal component of force that acts normal to the lower surface of the ribs 376 thereby increasing the frictional force on the button 250. This frictional force acts in opposition to any potential movement of the button 250 (to the left as viewed in FIG. 15). As can be seen, the above the motion of the button is: a) opposed by the inertial force acting upon the latch plate 180 (which counters the upward force generated by the button on the underside of the wings 190 of the latch plate) and b) opposed by the increased frictional force, both stiction (static friction) and sliding friction, generated at the interface of the stub axles and button ribs 376. Reference is briefly made to the right stub axle of FIG. 14. This axle includes a knurled, splined or grooved surface contour 380 which will further increase the frictional forces acting between the axles and the button ribs in comparison to using an axle with a smooth contour such as the stub axle on the right hand side of the weight 200'. As can be appreciated, the buckle of FIGS. 13–15 would have a third means for limiting the motion of the button 250 if optional ears or projections 350 are used. If only one open topped slot is used, one of the axles will be urged upwardly, as the other pivots within the opening 112, to generate a frictional force opposing the motion of the button. This moving axle can also include the friction enhancing surface characteristics.

Many changes and modifications in the above-described embodiment of the invention can, of course, be carried out without departing from the scope thereof. Accordingly, that scope is intended to be limited only by the scope of the appended claims.

We claim:

1. A seat belt buckle (100) operable with a pretensioner (330) for moving the buckle a determinable distance to remove belt slack about an occupant, the buckle comprising:

a frame (102), adapted to be connected to the pretensioner (330), having a tongue receiving opening (170) to receive a tongue (173), the frame having at least a first latch opening (126*a*) therein and the tongue including a second latch opening (175), and opposing frame sides (108*a,b*), each side including a latch plate slot (110) arranged generally perpendicular to the first direction;

a latch plate (180), having side portions (184) guidably movable within the latch plate slots (110), the latch plate moveable between a latched position within the first latch opening (126*a*) in the frame and within the second latch opening (173) of the tongue and an unlatched position out of the latch and tongue openings;

a pivoted weight (200) rotatable relative to the frame (102) and movable with the latch plate, the weight positioned upon a top portion of the latch plate when the latch plate is in its latched position; the weight (200) generating a force upon the latch plate during operation of the pretensioner tending to keep the latch plate in the first latch opening in opposition to forces generated by a button (250) acting on the latch plate and the button (250) being operatively received upon the frame and having lifting means (260) acting upon the latch plate for lifting the latch plate from its latched position to its unlatched position.

2. The buckle (100) as defined in claim 1 wherein the weight (200) includes at least one hook (204) which is positioned atop the latch plate (180) when in the latched position, the hook (204) including an arcuate engagement surface (206) which cooperates with a top portion of the latch plate (180) to provide a line force contact therebetween.

3. The buckle (100) as defined in claim 2 including two hooks (204) spaced from one another, each hook having an engagement surface (206) acting upon respective portions of the latch plate (180).

4. The buckle (100) as defined in claim 2 wherein each hook (204) defines a groove or pocket (204*a*) into which a respective top flat portion of the latch plate is received when in its unlatched position.

5. The buckle (100) as defined in claim 2 wherein the weight includes opposing wings (218) engaged and moved by laterally extending ends (190) of the latch plate (180), the wings (218) engaged by the latch plate ends (190) as the latch plate is moved to its latched position thereby rotating the weight placing the hooks (204) in position atop the latch plate.

6. The device as defined in claim 1 including a bias spring (226, 226*a*) for biasing the weight towards the latch to insure the weight is in contact with the latch prior to operation of a pretensioner.

7. A seat belt buckle (100), operable for use with a pretensioner (330) connected thereto for moving the buckle a determinable distance to remove belt slack about an occupant, the buckle comprising:

a frame (102), operatively connected to the pretensioner (330), having a tongue receiving opening (170) to receive a tongue (173), the frame having a first latch opening (126*a*) therein and the tongue including a second latch opening (175), a latch (180), guidably movable within the frame between a latched position wherein the latch is positioned within the first latch opening (126*a*) in the frame and within the second latch opening (173) of the tongue and an unlatched position wherein the latch is positioned out of the first and second latch openings;

a button (250) slidably mounted upon the frame including release means for initiating movement of the latch to its unlatched position as the button is moved inwardly relative to the frame; and friction means (372, 376) for generating a frictional force on a surface (376) of the button during the operation of the pretensioner to impede the motion of the button.

8. The device as defined in claim 7 further including weight means for generating a force, during the operation of the pretensioner, tending to keep the latch in the second latch opening in opposition to forces generated by the button (250) acting on the latch.

9. The device as defined in claim 8 wherein the weight means includes a pivoted weight (200) rotatable relative to the frame (102) and movable with the latch plate, the weight positioned upon a top portion of the latch plate when the latch plate is in its latched position.

10. The buckle (100) as defined in claim 9 wherein the weight includes opposing wings (218) each wing extends toward respective laterally extending end (190) of the latch plate (180), the wings (218) engaged by the latch plate ends (190) as the latch plate is moved to its latched position thereby rotating the weight to place hooks (204) associated with the weight means in position atop the latch plate.

11. The device as defined in claim 9 further includes blocking means for stopping the inward motion of the button.

12. The device as defined in claim 11 wherein the blocking means includes at least one projection on the weight means, the projections initially spaced from the button when the latch is in its latched position prior to the operation of the pretensioner, wherein excessive movement of the button causes the button to contact the projection, wherein further movement of the button is resisted by an inertial force on the weight means which acts through the projection.

13. The device as defined in claim 9 wherein the weight means includes integrally formed opposing axles supported upon a respective frame side.

14. The device as defined in claim 13 wherein the frame includes opposing frame sides and wherein at least one frame side includes an opened topped slot or notch (370) such that at least one axle is insertable therein through the slot.

15. The device as defined in claim 14 wherein each frame side includes an opened topped slot such that each axle is received with a respective slot.

16. The device as defined in claim 15 wherein each slot includes sides which are one of: vertically oriented, off-vertical and arcuate through which a respective axle moves.

17. The device as defined in claim 13 wherein at least one of the axles includes friction enhancing means for increasing the frictional force at the button.

18. The buckle (100) as defined in claim 8 wherein the weight means (200) includes at least one hook (204) which is positioned atop the latch (180) when in the latched position, the hook (204) including an arcuate engagement surface (206) which cooperates with a respective flat top portion of the latch (180) to provide a line force contact therebetween.

19. The buckle (100) as defined in claim 18 including two hooks (204) spaced from one another, each hook having an engagement surface (206) action upon respective portions of the latch plate (180).

20. The buckle (100) as defined in claim 18 wherein each hook (204) defines a groove or pocket (204*a*) into which the respective top flat portion of the latch plate is received when in its unlatched position.

21. The device as defined in claim 8 including a bias spring (226, 226*a*) for biasing the weight means towards the latch to insure the weight means is in contact with the latch prior to operation of a pretensioner.

22. The device as defined in claim 8 wherein the friction means is part of the weight means.

23. The device as defined in claim 7 wherein the frame further includes opposing frame sides (108*a,b*), each side including a latch plate slot (110) arranged generally perpendicular to the first direction; and wherein the latch includes side portions (184) guidably movable within the latch plate slots (110) of the frame.

24. The device as defined in claim 23 wherein the frame includes opposing frame sides (108*a,b*) and wherein the weight means is pivotally mounted upon the sides.

25. The device as defined in claim 24 wherein the weight means is supported on the frame sides by a pin or rod which extends through the frame sides.

* * * * *